US010674248B2

(12) United States Patent
Wei et al.

(10) Patent No.: US 10,674,248 B2
(45) Date of Patent: Jun. 2, 2020

(54) EAR-HANGING TYPE STRUCTURE AND EARPHONE INCLUDING EAR-HANGING TYPE STRUCTURE

(71) Applicant: DONGGUAN KOPPO ELECTRONICS CO, LLD., Dongguan, Guangdong (CN)

(72) Inventors: Yongning Wei, Guangdong (CN); Linjun Li, Guangdong (CN)

(73) Assignee: DONGGUAN KOPPO ELECTRONICS CO, LLD., Dongguan (CN)

( * ) Notice: Subject to any disclaimer, the term of this patent is extended or adjusted under 35 U.S.C. 154(b) by 0 days.

(21) Appl. No.: 16/502,021

(22) Filed: Jul. 2, 2019

(65) Prior Publication Data

US 2019/0327548 A1 Oct. 24, 2019

Related U.S. Application Data

(63) Continuation-in-part of application No. PCT/CN2017/118940, filed on Dec. 27, 2017.

(30) Foreign Application Priority Data

Jan. 3, 2017 (CN) ..... 2017 2 0002816 U

(51) Int. Cl.
*H04R 1/10* (2006.01)

(52) U.S. Cl.
CPC ..... *H04R 1/105* (2013.01); *H04R 1/1016* (2013.01); *H04R 1/1058* (2013.01)

(58) Field of Classification Search
CPC ..... H04R 1/105; H04R 1/1016; H04R 1/1058
See application file for complete search history.

(56) References Cited

U.S. PATENT DOCUMENTS 8,848,964 B2 * 9/2014 Erdel ..... H04R 1/1091 381/338
9,516,402 B2 * 12/2016 Murozaki ..... H04R 1/1016
(Continued)

FOREIGN PATENT DOCUMENTS

CN 105392080 A 3/2016
CN 205305064 U 6/2016
CN 106231476 A 12/2016

OTHER PUBLICATIONS

International search report of PCT Patent Application No. PCT/CN2017/118940 dated Apr. 4, 2018.

*Primary Examiner* — Oyesola C Ojo

(57) ABSTRACT

The present disclosures an ear-hanging type structure. The ear-hanging type structure comprises an ear supporting part, the ear supporting part comprises a protrusion part, a cavity part and a connection part for connecting the protrusion part with the cavity part, the protrusion part is provided with a hollow structure, and the protrusion part, the connection part and the cavity part are mutually communicated; and a partial periphery of the ear supporting part corresponds to the anti-helix of an ear and is arranged along an inner side of the anti-helix. Compared with the prior art, the present disclosure has the advantages that the partial periphery of the ear supporting part corresponds to the anti-helix of the ear and is arranged along the inner side of the anti-helix so as to improve fitness of the ear-hanging type structure and the ear, use comfortableness and wear stability without discomfortableness after long-time wearing.

6 Claims, 6 Drawing Sheets

(56) References Cited

U.S. PATENT DOCUMENTS

| | | | | |
|---|---|---|---|---|
| 10,178,464 | B2 * | 1/2019 | Hussein | A61F 11/08 |
| 2010/0135517 | A1 * | 6/2010 | Murozaki | H04R 1/1016 381/386 |
| 2011/0268308 | A1 * | 11/2011 | Vasquez | H04R 1/1016 381/380 |
| 2015/0030194 | A1 * | 1/2015 | Burgett | H04R 1/1016 381/380 |
| 2016/0066110 | A1 * | 3/2016 | Shennib | H04R 25/652 381/328 |
| 2016/0261942 | A1 * | 9/2016 | Hayden | H04R 1/105 |
| 2016/0277825 | A1 * | 9/2016 | Johansson | H04R 1/1091 |
| 2016/0317352 | A1 * | 11/2016 | Blumer | H04R 25/60 |
| 2017/0339481 | A1 * | 11/2017 | Laberge | H04R 1/1016 |
| 2018/0035192 | A1 * | 2/2018 | Houle | H04R 1/1016 |
| 2018/0035196 | A1 * | 2/2018 | Yeung | H04R 1/1025 |
| 2018/0115813 | A1 * | 4/2018 | Jou | H04R 1/1058 |

* cited by examiner

EAR-HANGING TYPE STRUCTURE AND EARPHONE INCLUDING EAR-HANGING TYPE STRUCTURE

CROSS REFERENCE TO RELATED APPLICATIONS

The present application is a Continuation-In-Part application of PCT Application No. PCT/CN2017/118940 filed on Dec. 27, 2017, which claims the benefit of Chinese Patent Application No. 201720002816.7 filed on Jan. 3, 2017. All the above are hereby incorporated by reference.

TECHNICAL FIELD

The present disclosure belongs to the technical fields of earphones, and in particular to an ear-hanging type structure and an earphone including the ear-hanging type structure.

BACKGROUND

With the continuous improvement of the living standards of people, more and more people use the earphone, especially a small earphone. Due to its portability, the small earphone is very popular in the consumers; and its application range is expanded from the early small radio and Walkman to various novel electronic devices including the mobile phone, the portable Walkman (such as CD-player) and the like.

In order to help a user to conveniently wear the earphone, some manufacturers develop an earphone with a head band, the user can use the head band to cross the head top to use the earphone so as to provide suitable hanging and supporting effects. However, this kind of earphone may press the hair of the user in use to break the hair style of the user, so its sale quantity is limited to a certain extent.

Therefore, there are some manufacturers to develop an ear-hanging type structure which generally is combined with the earphone to form a whole body and is hung the ear in use, wherein a loudspeaker is arranged at one end of the ear-hanging type structure while a transmission line extends from the other end thereof to be connect with a player. When this ear-hanging type structure needs to be stored, the transmission line unavoidably needs to be folded in order to reduce the occupancy space of the ear-hanging type structure, and at this time, the transmission line may be excessively folded to be broken, thereby causing damage of the ear-hanging type structure.

On this basis, an ear-hanging type structure attached in the ear of the user is developed to provide an attachment force for the earphone, but in the prior art, the attached ear-hanging type structure is lack of comfortableness and stability and cannot meet requirements of the user, and the ears of everyone have different sizes, so the existing attached ear-hanging type structure cannot meet the requirements of all users.

Therefore, it is necessary to provide an ear-hanging type structure and an earphone including the ear-hanging type structure, the ear-hanging type structure has improved fitness with the ear and can improve the use comfortableness and wearing stability without discomfortableness after long-term wearing, and the ear-hanging type structure can be applied to different sizes of the ears.

SUMMARY

One of objectives of the present disclosure is to provide an ear-hanging type structure, which improves fitness with the ear, use comfortableness and wear stability without discomfortableness after long-time wearing and can be applied to different sizes of ears, by aiming at defects in the prior art.

In order to achieve the above objective, the present disclosure adopts the following technical solutions.

The ear-hanging type structure comprises an ear supporting part, the ear supporting part comprises a protrusion part, a cavity part and a connection part for connecting the protrusion part with the cavity part, the protrusion part is provided with a hollow structure, and the protrusion part, the connection part and the cavity part are mutually communicated; and a partial periphery of the ear supporting part corresponds to the anti-helix of an ear and is arranged along an inner side of the anti-helix.

As an improvement of the ear-hanging type structure of the present disclosure, an outer surface of the connection part is a diameter-decreasing arc.

As an improvement of the ear-hanging type structure of the present disclosure, an included angle between a plane, at which an external end face of the protrusion part is located, and a plane, at which an external end face of the cavity part, is 0-90 degrees.

As an improvement of the ear-hanging type structure of the present disclosure, a projection of the external end face of the protrusion part on the external end face of the cavity part is located at a non-center portion of the external end face of the cavity part.

As an improvement of the ear-hanging type structure of the present disclosure, the cavity part comprises a body and a mounting part, and the diameter of the mounting part is less than the diameter of the body.

As an improvement of the ear-hanging type structure of the present disclosure, groove parts are arranged at an edge of the body.

As an improvement of the ear-hanging type structure of the present disclosure, a groove part is arranged on the body.

Compared with the prior art, the ear-hanging type structure of the present disclosure comprises the ear supporting part, the ear supporting part comprises the protrusion part, the cavity part and the connection part for connecting the protrusion part with the cavity part, the protrusion part is provided with the hollow structure, and the protrusion part, the connection part and the cavity part are mutually communicated; and the partial periphery of the ear supporting part corresponds to the anti-helix of the ear and is arranged along the inner side of the anti-helix. The partial periphery of the ear supporting part corresponds to the anti-helix of the ear and is arranged along the inner side of the anti-helix so as to improve fitness of the ear-hanging type structure and the ear, use comfortableness and wear stability without discomfortableness after long-time wearing. When the groove part is arranged on the body or at the edge of the body, the ear-hanging type structure can be applied to different sizes of ears.

Another objective of the present disclosure is to provide an earphone, which comprises a connecting line, a back cover, a flared cavity, a soft earplug part and an ear-hanging type structure, one end of the connecting line is embedded in the back cover, one end of the flared cavity is connected with the back cover, the ear-hanging type structure sleeves the main body of the flared cavity, and the soft earplug part sleeves an end portion, away from the back cover, of the flared cavity; and the ear-hanging type structure is the ear-hanging type structure of the present disclosure.

As an improvement of the earphone of the present disclosure, the soft earplug part is embedded in the cavity of auricular concha of the ear and is partially located in a lower portion of the antitragus of the ear, the soft earplug part has a two-end-opened hollow structure, and the diameter of an opening of one end, away from the back cover, of the soft earplug part is less than the diameter of an opening of one end, close to the back cover, of the soft earplug part.

Compared with the prior art, the earphone is provided with the ear-hanging type structure of the present disclosure so as to improve fitness of the ear-hanging type structure and the ear, use comfortableness and wear stability without discomfortableness after long-time wearing; and the earplug part is made of a soft material, and the earplug part is embedded in the cavity of auricular concha of the ear and is partially located in the lower portion of the antitragus of the ear so that the earplug part can be applied to various sizes of ears.

DESCRIPTION OF THE EMBODIMENTS

The present disclosure and its beneficial effects will be further described in detail with reference to the embodiments, but the embodiments of the present disclosure are not limited to the described content.

Embodiment 1

Figure 10:
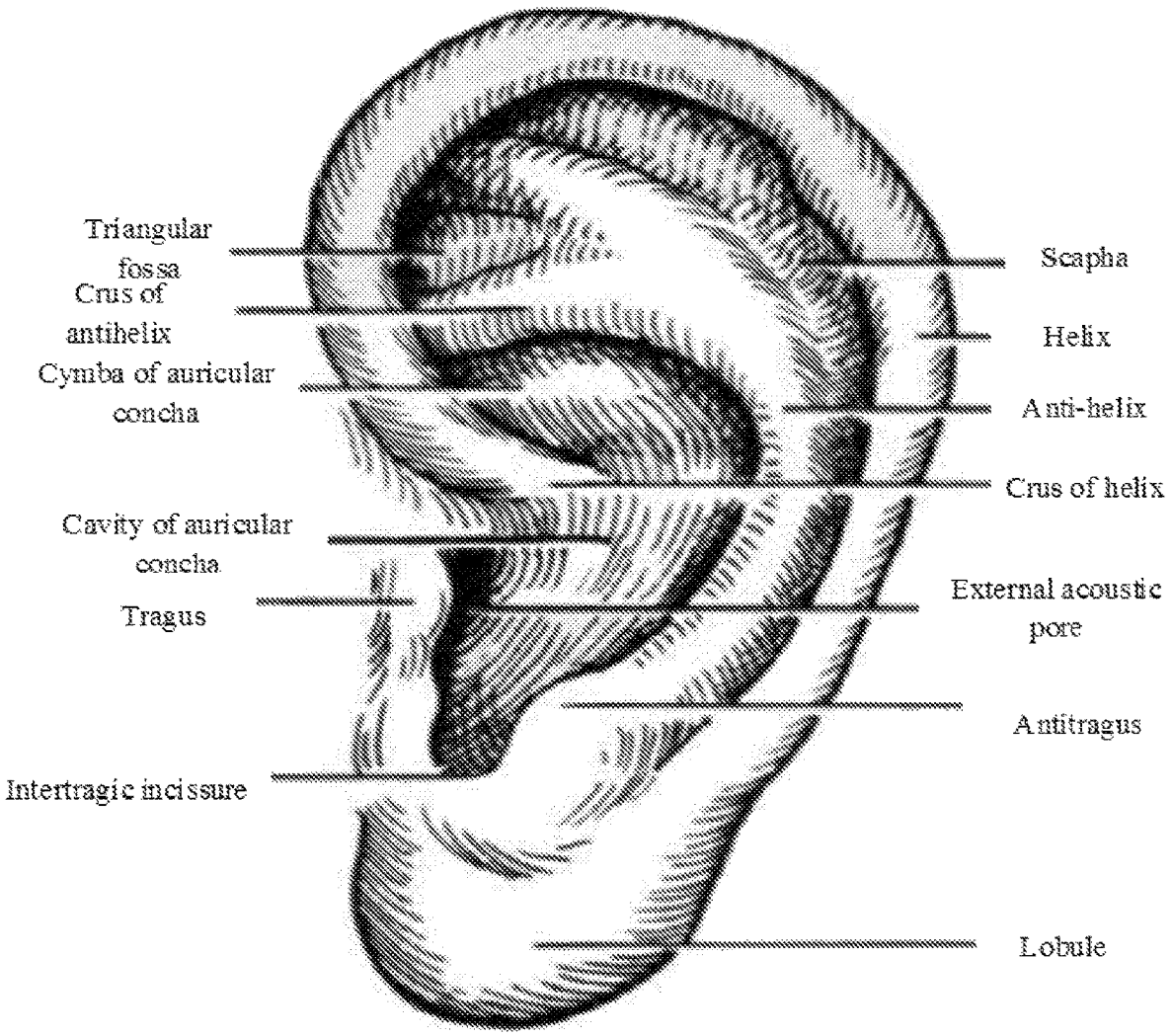
FIG. 10 is a schematic structural diagram of the human ear.

As shown in FIG. 1 to FIG. 4, an ear-hanging type structure provided by the present disclosure comprises an ear supporting part 1, the ear supporting part 1 comprises a protrusion part 11, a cavity part 12 and a connection part 13 for connecting the protrusion part 11 with the cavity part 12, the protrusion part 11 is provided with a hollow structure, and the protrusion part 11, the connection part 13 and the cavity part 12 are mutually communicated. The connection part 13 per se is also hollow so as to facilitate insertion of a flared cavity. Arrangement of the ear supporting part 1 can improve wearing stability of the ear-hanging type structure. A partial periphery of the ear supporting part 1 corresponds to the anti-helix of an ear and is arranged along an inner side of the anti-helix so as to improve fitness of the ear-hanging type structure and the ear, use comfortableness and wear stability without discomfortableness after long-time wearing. For ease of understanding, the present disclosure specifically provides a structure of the human ear, as shown in FIG. 10. The present disclosure is designed based on ergonomics, is more user friendly and has high use comfortableness.

An outer surface of the connection part 13 is a diameter-decreasing arc, and the connection part 13 having such structure cannot only have an attractive appearance, but also can greatly fit to the ear to improve the wear stability.

An included angle between a plane, at which an external end face of the protrusion part 11 is located, and a plane, at which an external end face of the cavity part 12, is 0-90 degrees, preferably 10-50 degrees, that is, the external end face of the protrusion part 11 and the external end face of the cavity part 12 are not in parallel, but form a certain included angle, so that a soft earplug part 2 has a certain inclined angle to facilitate plugging in the cavity of auricular concha of the ear.

A projection of the external end face of the protrusion part 11 on the external end face of the cavity part 12 is located at a non-center portion of the external end face of the cavity part 12, that is, the protrusion part 11 is laterally arranged corresponding to a center line of the connection part 13 and is not arranged at a central portion of the connection part 13. Such design is used for improving the fitness with the ear.

The cavity part 12 comprises a body 121 and a mounting part 122, the diameter of the mounting part 122 is less than the diameter of the body 121, and the arrangement of the mounting part 122 facilitates connection with other parts of a earphone. Groove parts 123 are arranged at an edge of the body 121, and the groove part 123 is sunken from the surface of the body 121 to the interior of the cavity part 12, but does not penetrate through the body 121. The groove parts 123 are arranged at the edge of the body 121, and the groove part 123 provides a deformation space; when the ear-hanging type structure incompletely matches with the ear in size, an inner side of the anti-helix props against the body 121 to cause deformation of the body 121 when the ear supporting part 1 is plugged into the ear, and at this time, the groove parts 123 provide deformation spaces for the body 121 to prevent the fact that the deformed body 121 is accumulated on the inner side of the anti-helix to extrude the anti-helix and then to cause the ear painful.

The groove part 123 extends from an edge of the body 121 to the connection part 13, and in this extension direction, the groove part 123 is arranged in an arc shape. In the embodiment, three groove parts 123 are arranged, and one end, close to the connection part 13, of the three groove parts 123 is closed up inwards, that is, the three groove parts 123 are not arranged in parallel, but the middle groove part 123 is arranged vertical to the connection part 13 while one end, close to the connection part 13, of the two side groove parts 123 is closed up towards the middle groove part 123; therefore, when the ear-hanging type structure is worn, the body 121 deforms towards the middle groove part 123. In other embodiments, two or more than three groove parts 123 may be arranged. Arrangement of the groove parts 123 can help the ear-hanging type structure to be applied to different sizes of ears and prevents the fact that the anti-helix is extruded cause the ear painful after the ear-hanging type structure is worn.

Embodiment 2

Figure 1:
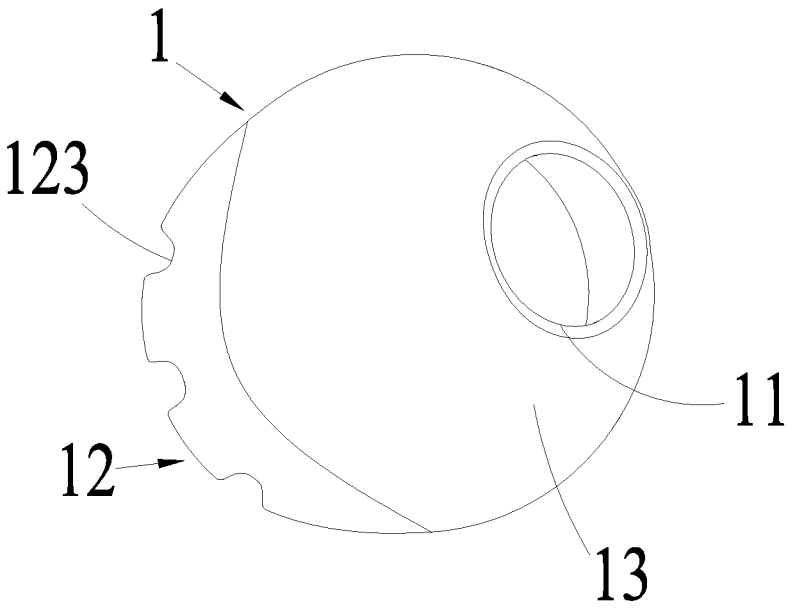
FIG. 1 is a schematic diagram of a stereo structure of Embodiment 1 of the present disclosure.
Figure 2:
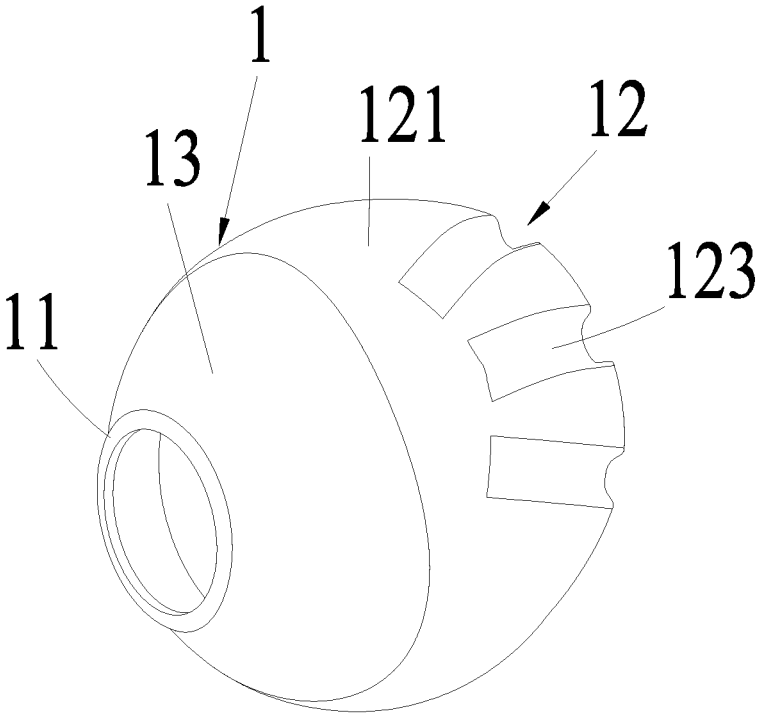
FIG. 2 is another schematic diagram of a stereo structure of Embodiment 1 of the present disclosure.
Figure 3:
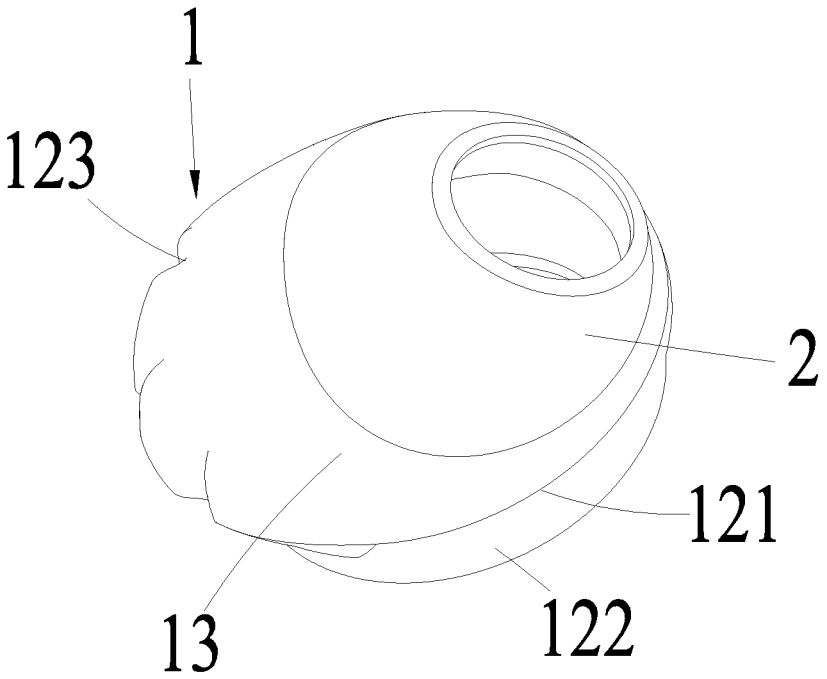
FIG. 3 is a schematic diagram of a stereo structure after an ear-hanging type structure of Embodiment 1 of the present disclosure is combined with a soft earplug part.
Figure 4:
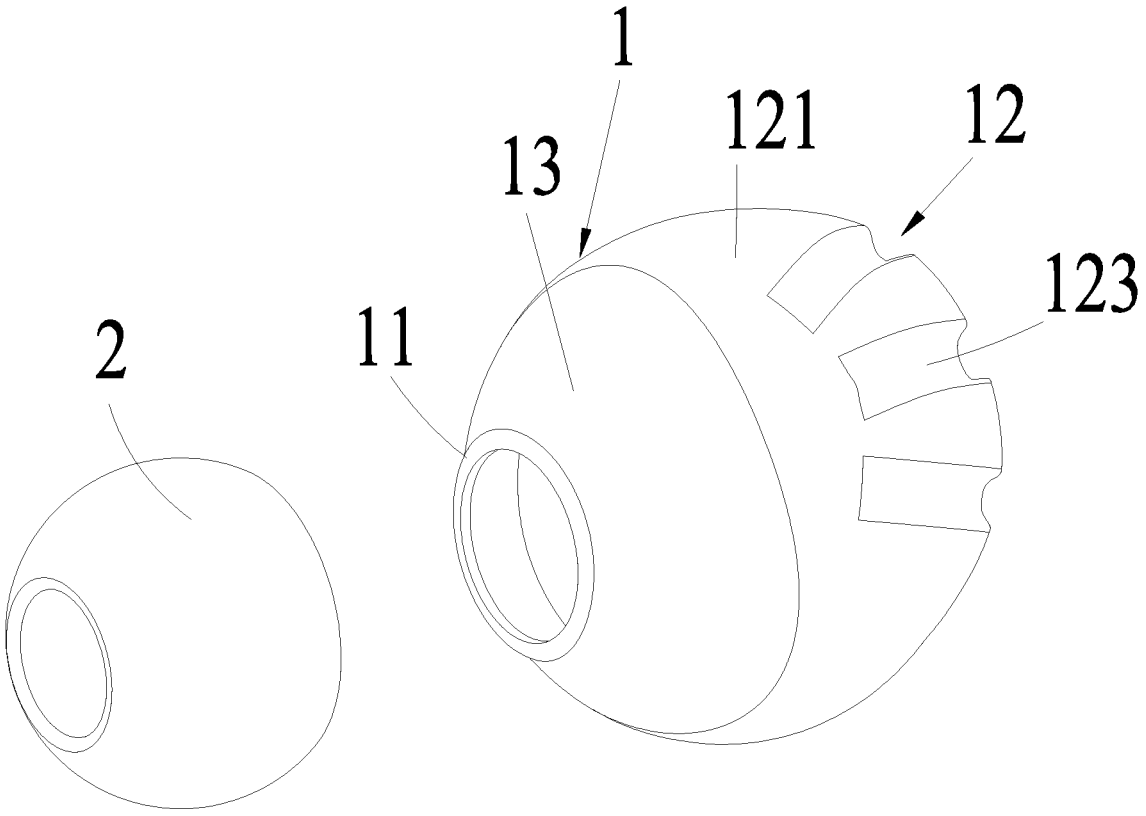
FIG. 4 is an exploded view of FIG. 3.
Figure 5:
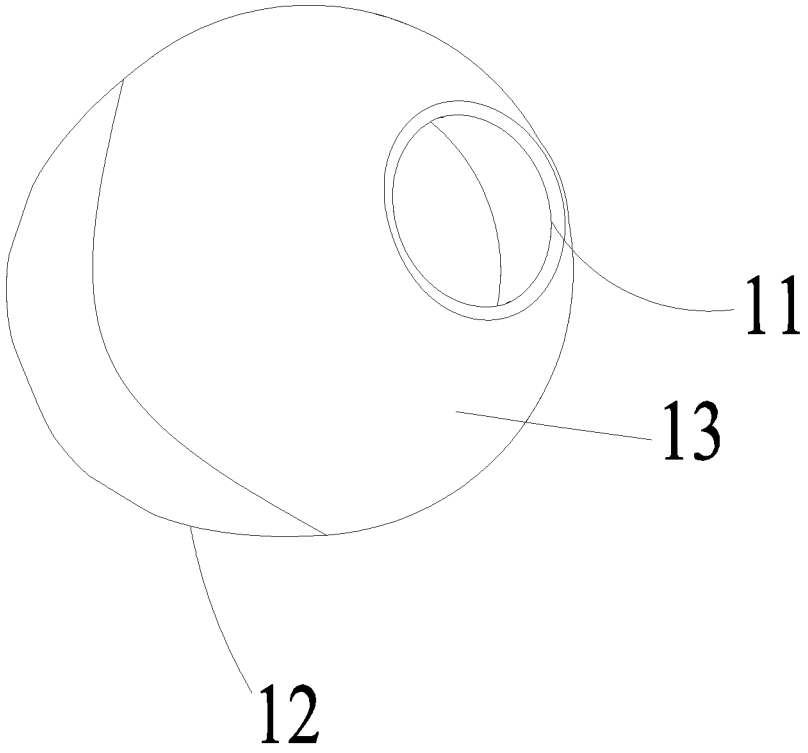
FIG. 5 is a schematic diagram of a stereo structure of Embodiment 2 of the present disclosure.
Figure 6:
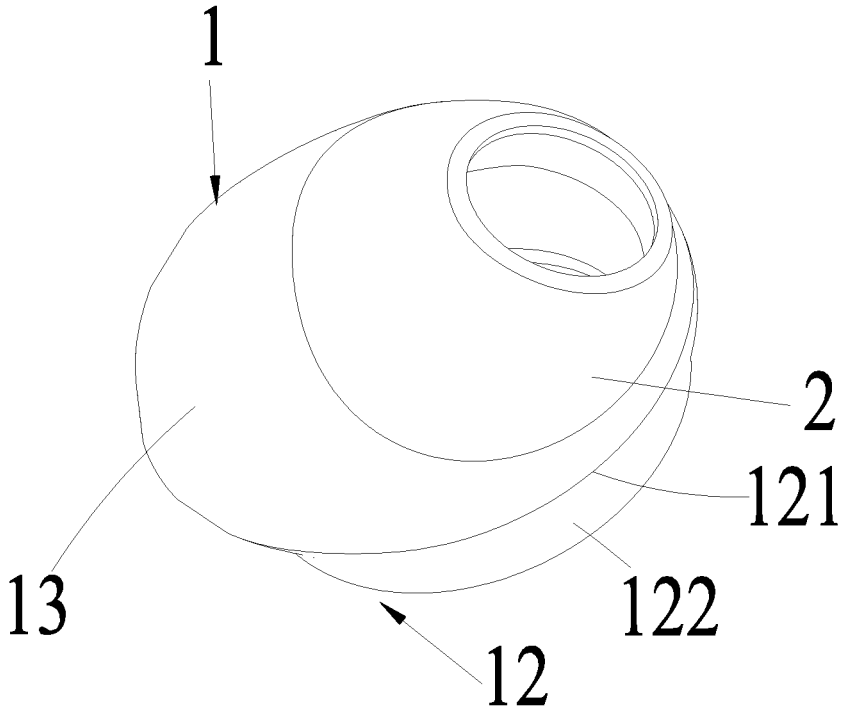
FIG. 6 is a schematic diagram of a stereo structure after an ear-hanging type structure of Embodiment 2 of the present disclosure is combined with a soft earplug part.

As shown in FIG. 5 and FIG. 6, the difference from Embodiment 1 lies on: the edge of the body 121 of the ear-hanging type structure provided by the embodiment is not provided with the groove part 123, and the other arrangement is the same as the arrangement of Embodiment 1 and is not described again herein.

Embodiment 3

Figure 7:
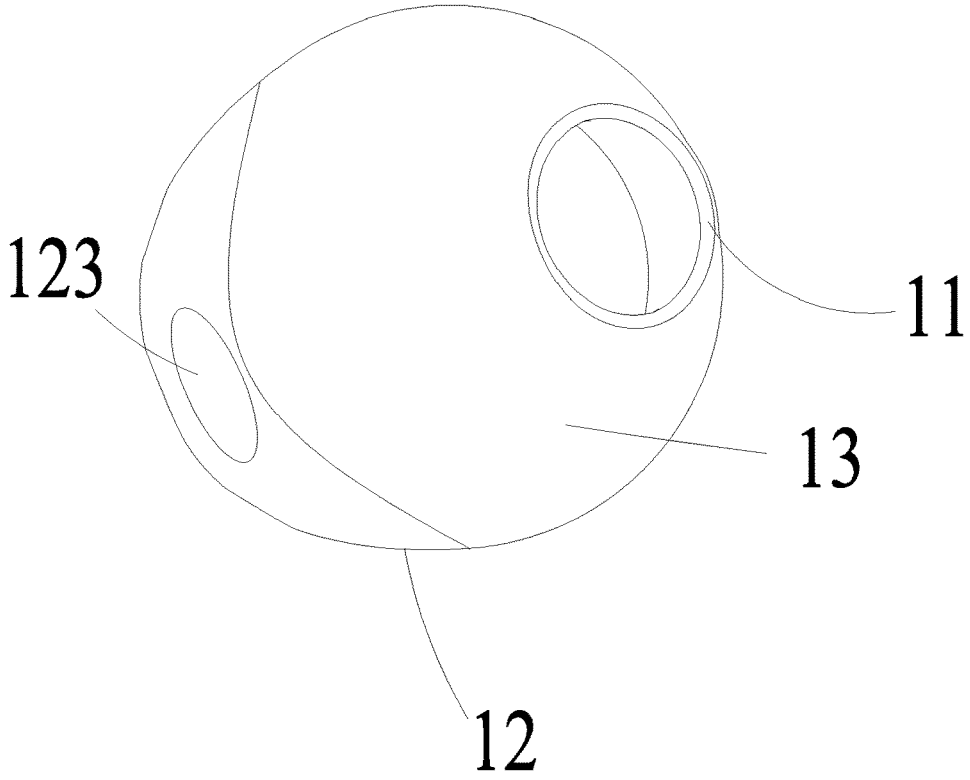
FIG. 7 is a schematic diagram of a stereo structure of Embodiment 3 of the present disclosure.
Figure 8:
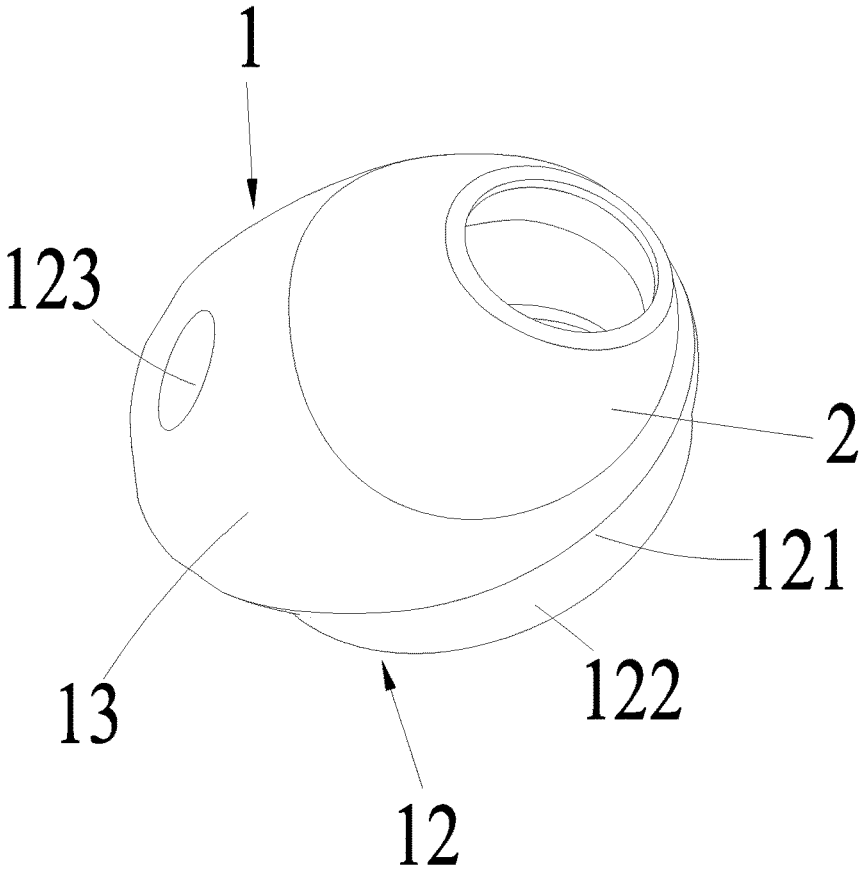
FIG. 8 is a schematic diagram of a stereo structure after an ear-hanging type structure of Embodiment 3 of the present disclosure is combined with a soft earplug part.

As shown in FIG. 7 and FIG. 8, the difference from Embodiment 1 lies on: the body 121 of the ear-hanging type structure provided by the embodiment is provided with the groove part 123, the groove part 123 is sunken from the surface of the body 121 to the interior of the cavity part 12, but does not penetrate through the body 121, and the sunken portion is semicircular. The other arrangement is the same as the arrangement of Embodiment 1 and is not described again herein. In the embodiment, one groove part 123 is arranged and is located at the center of the body 121, but in other embodiments, two or more groove parts 123 may be arranged. The groove part 123 provides the deformation space for the body 121; when the earplug part 1 incompletely matches with the ear, an inner side of the anti-helix extrudes the body 121, and the body 121 deforms towards the middle groove part 123; and the groove part 123 provides the deformation space so as to prevent the fact that the extruded accumulated body 121 reversely props against the inner side of the anti-helix to cause the ear painful.

Embodiment 4

Figure 9:
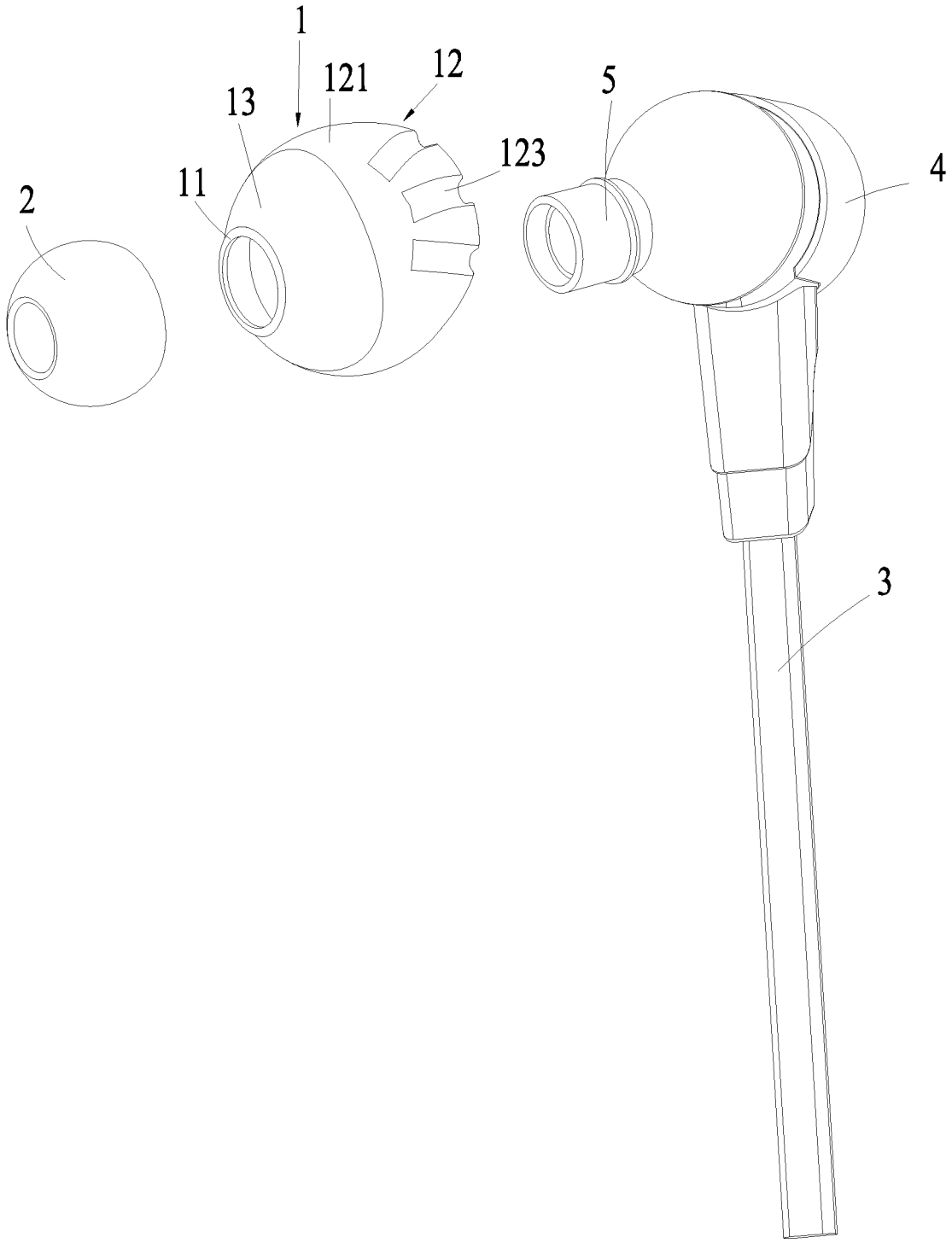
FIG. 9 is an exploded view of Embodiment 4 of the present disclosure.

As shown in FIG. 9, the embodiment provides an earphone, comprising a connecting line 3, a back cover 4, a flared cavity 5, a soft earplug part 2 and the ear-hanging type structure, one end of the connecting line 3 is embedded in the back cover 4, one end of the flared cavity 5 is connected with the back cover 4, the ear-hanging type structure sleeves the main body of the flared cavity 5, the soft earplug part 2 sleeves an end portion, away from the back cover 4, of the flared cavity 5, and the ear-hanging type structure is any ear-hanging type structure in Embodiment 1, Embodiment 2 and Embodiment 3. In use, the soft earplug part 2 is embedded in the cavity of auricular concha of the ear and is partially located in a lower portion of the antitragus of the ear, and the partial periphery of the ear supporting part 1 corresponds to the anti-helix of the ear and is arranged along the inner side of the anti-helix. The earplug part is made of a soft material so that the earplug part can be applied to various sizes of ears. In the embodiment, the material of the soft earplug part 2 is silica gel.

Wherein the soft earplug part 2 has a two-end-opened hollow structure, and the diameter of an opening of one end, away from the back cover 4, of the soft earplug part 2 is less than the diameter of an opening of one end, close to the back cover 4, of the soft earplug part 2.

According to disclosure and education of the above specification, persons skilled in the art may further change and modify the above embodiments. Therefore, the present disclosure is not limited to the above disclosed and described embodiments, and some changes and modifications made to the present disclosure should fall in the protection scope of the claims of the present disclosure. Furthermore, although some specific terms are used in the specification, these terms merely are used for ease of presentation, but do not limit to the present disclosure.

What is claimed is:

1. An ear-hanging type structure, comprising an ear supporting part, wherein the ear supporting part comprises a protrusion part, a cavity part and a connection part for connecting the protrusion part with the cavity part, the protrusion part is provided with a hollow structure, and the protrusion part, the connection part and the cavity part are mutually communicated; and a partial periphery of the ear supporting part corresponds to the anti-helix of an ear and is arranged along an inner side of the anti-helix;

wherein the cavity part comprises a body and a mounting part, and the diameter of the mounting part is less than the diameter of the body;

three groove parts are arranged at an edge of the body and extend from the edge of the body to the connection part, and one end, close to the connection part, of the three groove parts is closed up inwards; and the three groove parts comprises a middle groove and two side groove parts, the middle groove part being arranged vertical to the connection part, and the one end, close to the connection part, of the two side groove parts is closed up towards the middle groove part.

2. The ear-hanging type structure according to claim 1, wherein an outer surface of the connection part is a diameter-decreasing arc.

3. The ear-hanging type structure according to claim 1, wherein an included angle between a plane, at which an external end face of the protrusion part is located, and a plane, at which an external end face of the cavity part, is 0-90 degrees.

4. The ear-hanging type structure according to claim 3, wherein a projection of the external end face of the protrusion part on the external end face of the cavity part is located at a non-center portion of the external end face of the cavity part.

5. An earphone, comprising a connecting line, a back cover, a flared cavity, a soft earplug part and an ear-hanging type structure, wherein one end of the connecting line is embedded in the back cover, one end of the flared cavity is connected with the back cover, the ear-hanging type structure sleeves the main body of the flared cavity, and the soft earplug part sleeves an end portion, away from the back cover, of the flared cavity; and the ear-hanging type structure is the ear-hanging type structure according to claim 1.

6. The earphone according to claim 5, wherein the soft earplug part is embedded in the cavity of auricular concha of the ear and is partially located in a lower portion of the antitragus of the ear, the soft earplug part has a two-end-opened hollow structure, and the diameter of an opening of one end, away from the back cover, of the soft earplug part is less than the diameter of an opening of one end, close to the back cover, of the soft earplug part.

* * * * *